United States Patent [19]

Gabriel, Jr.

[11] 3,967,913

[45] July 6, 1976

[54] ASPHALT ROADWAY PATCHING APPARATUS

[76] Inventor: Gifford W. Gabriel, Jr., 8198 S. Marshall St., Littleton, Colo. 80123

[22] Filed: Dec. 16, 1974

[21] Appl. No.: 533,158

[52] U.S. Cl. ..... 404/109; 198/213

[51] Int. Cl.[2] ..... E01C 19/18

[58] Field of Search ..... 404/108, 101, 131, 102, 404/109; 198/213

[56] References Cited

UNITED STATES PATENTS

| | | | |
|---|---|---|---|
| 1,813,728 | 7/1931 | Chase | 404/83 X |
| 3,217,620 | 11/1965 | Mindrum | 404/108 X |
| 3,331,297 | 7/1967 | Bettino | 404/131 X |
| 3,396,644 | 8/1968 | Banks | 404/108 X |
| 3,398,662 | 8/1968 | Takata | 404/108 X |
| 3,678,817 | 7/1972 | Martenson | 404/84 |

*Primary Examiner*—Nile C. Byers

[57] ABSTRACT

A supply hopper, arranged for lowering for filling and elevating for operation, mounted in an elevated position on a vehicle, is arranged with a heated spiral flight discharge conveyor and arranged to discharge into a small mobile distribution hopper. The distribution hopper is mounted on an articulated mounting for movement throughout an area around and adjacent to the vehicle, for distributing asphaltic material to holes needing patching, burners for heating the hole, and a tamper is, also, mounted on the articulated mounting. The patching is accomplished by one worker operating the patching mechanism.

7 Claims, 9 Drawing Figures

60
64
62
63
64
53

36
48
47
46
46b
42
43
44
46a
48
47

79
68
68a
75
60
76
53

63a
63
60
65
64
62
61

46c
49
46b
46
49
46a
49a

ASPHALT ROADWAY PATCHING APPARATUS

This invention relates to an asphalt roadway patcher, and particularly to the combination of a vehicle having an elevating supply hopper and a small distribution hopper mounted with heaters and a tamper, for a one worker asphalt patching apparatus.

Previously, a number of devices have been suggested for the use in the repairing of highways, generally those which may be patched with an asphaltic material. A major object of such devices was not only to speed up the repair of the highways but reducing the number of personnel required for effecting the repair. Some of the proposed devices require a vehicle which is in motion during its use, obviously depriving the operator of a direct view of the area which is to be repaired. In other devices, it was suggested that the vehicle remain stationary during the repair operations. For example, U.S. Pat. No. 3,217,620, issued Nov. 16, 1965, describes a self-propelled machine having an elevated hopper and an articulated tool arm extending from the hopper for distributing and tamping asphaltic material from the hopper. The unit is provided with a large elevated hopper so that it may be transported from a hot mix plant to repair sites as a complete unit, and is operable by a single operator. An obvious disadvantage of such a unit is the cooling of the asphaltic mix during transportation from the plant to the points of repair. It has been found by actual repair work over a number of years that the patching asphalt must be hot or it will not bind with the old asphalt of the roadway.

It is, therefore, an object of the invention to provide a vehicle provided with the means for effectively patching holes in roadways with asphaltic material.

Another object of the invention is to provide a vehicle arranged for patching roadways while the vehicle is in a stationary position.

Still another object of the invention is to provide means for a road patching vehicle for accepting small loads of asphaltic material from conventional dump trucks for use in the patching apparatus.

Yet another object of the invention is to provide a roadway patching apparatus having an elevating hopper arranged to be heated by means of a spiral flight conveyor to provide effectively heated asphalt to a distribution hopper for transfer to holes requiring patching.

Another object of the invention is to provide patching apparatus which may be in the form of a trailer arrangement for attachment to a prime mover and having an elevating hopper for filling in a lower position and for distribution in its upper operating position.

An additional object of the invention is to provide a vehicle which may be arranged as a self-propelled single unit providing a loading hopper from a lower position to an elevated operation position and providing means for distributing the asphalt from the supply hopper to an area adjacent to the vehicle for patching a roadway while the vehicle is stationary and providing the necessary tools for such patching throughout the area of operation adjacent to the vehicle.

These and other objects and advantages of the invention may be ascertained by referring to the following description and appended illustrations, in which.

Figure 1:
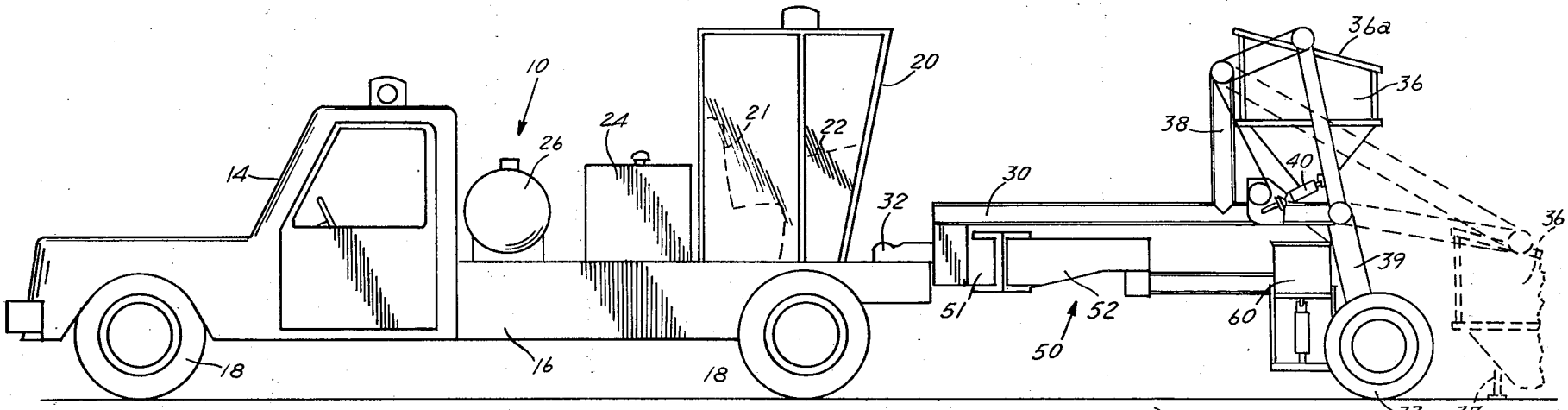
FIG. 1 is a side elevational view of one form of the invention illustrating both the loading and an operating position for a supply hopper.
Figure 2:
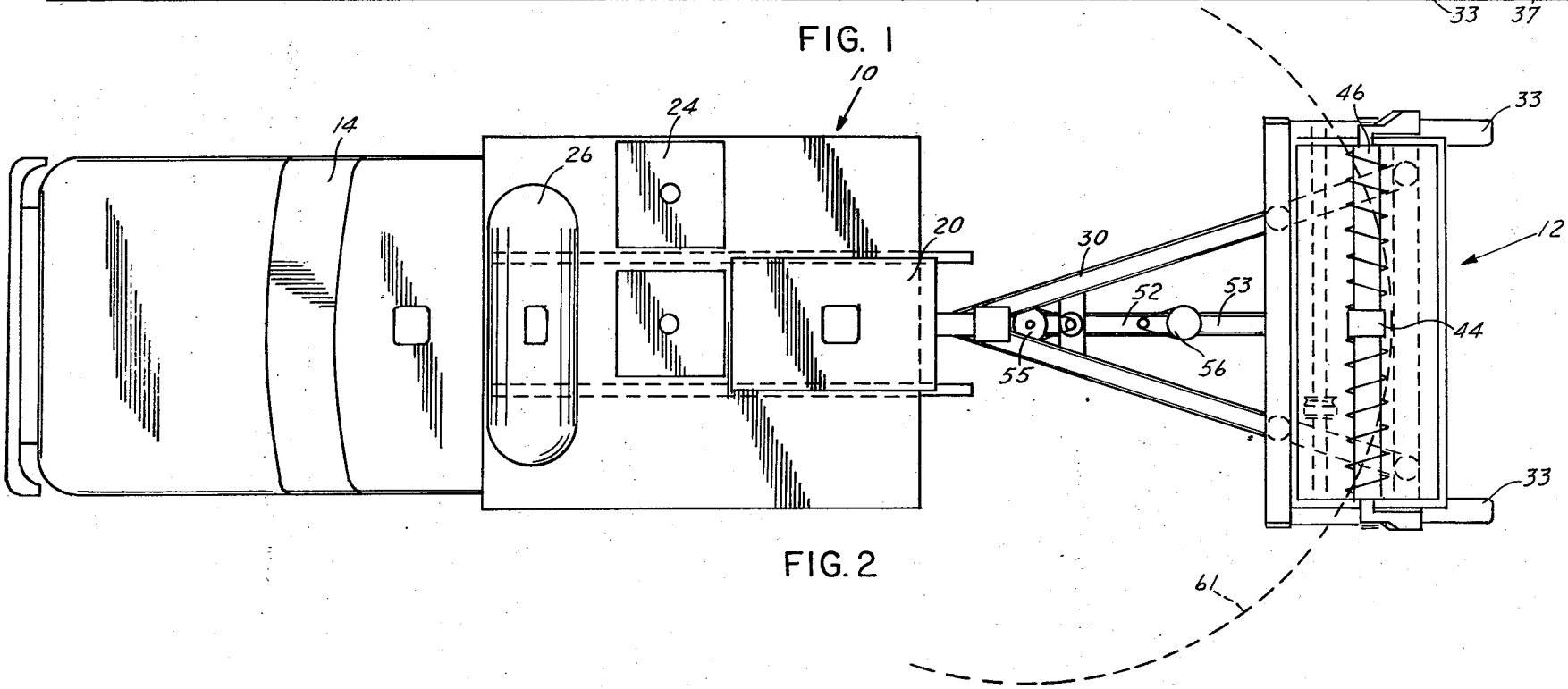
FIG. 2 is a top plan view of the device of FIG. 1 illustrating a field of operation of the patching tools of the vehicle.

In the device selected for illustration in FIGS. 1–7, a prime mover, shown in general by numeral 10, is provided with a two wheel trailer attachment shown in general by numeral 12. The prime mover is a four or more wheel vehicle including a cab 14, a frame 16 and a plurality of wheels 18 for mobility, as is conventional. The cab 14 contains the usual operating controls for a self-propelled vehicle, so that this vehicle may provide motivating power for the patcher equipment mounted on the trailer 12. The vehicle 10, also, includes a cab 20 containing the controls for the patching equipment mounted on the trailer, and it contains a seat 21 and a control panel 22 (both shown in dashed lines). The cab 20 is provided with a substantial amount of glass or transparent covering so that the operator may have full visual observation of the trailer and the road on which the unit is parked. Mounted on the prime mover 10 is a hydraulic pump and reservoir 24, shown in block diagram, and a reservoir tank 26 for the tack oil for providing bonding of asphalt patching material to the highway holes.

The trailer 12 is provided with an A-frame 30 having a hitch 32 at the front end mounted on the rear of the truck 10 and a pair of spaced apart wheels 33 on mounts extended downwardly from the ends of the A-frame. An elevated supply hopper 36 is mounted for movement from an upper position to a lower position on a framework 38 controlled by hydraulic cylinders 39 at each side of the reservoir. Feet 37 are provided on the reservoir for supporting the same when it is on the ground, and the top opening 36a is formed at an angle so that a conventional dump truck may fill the supply hopper on the ground from the dump truck as it is tilted.

Figures 3, 4, 5, 6, 7:
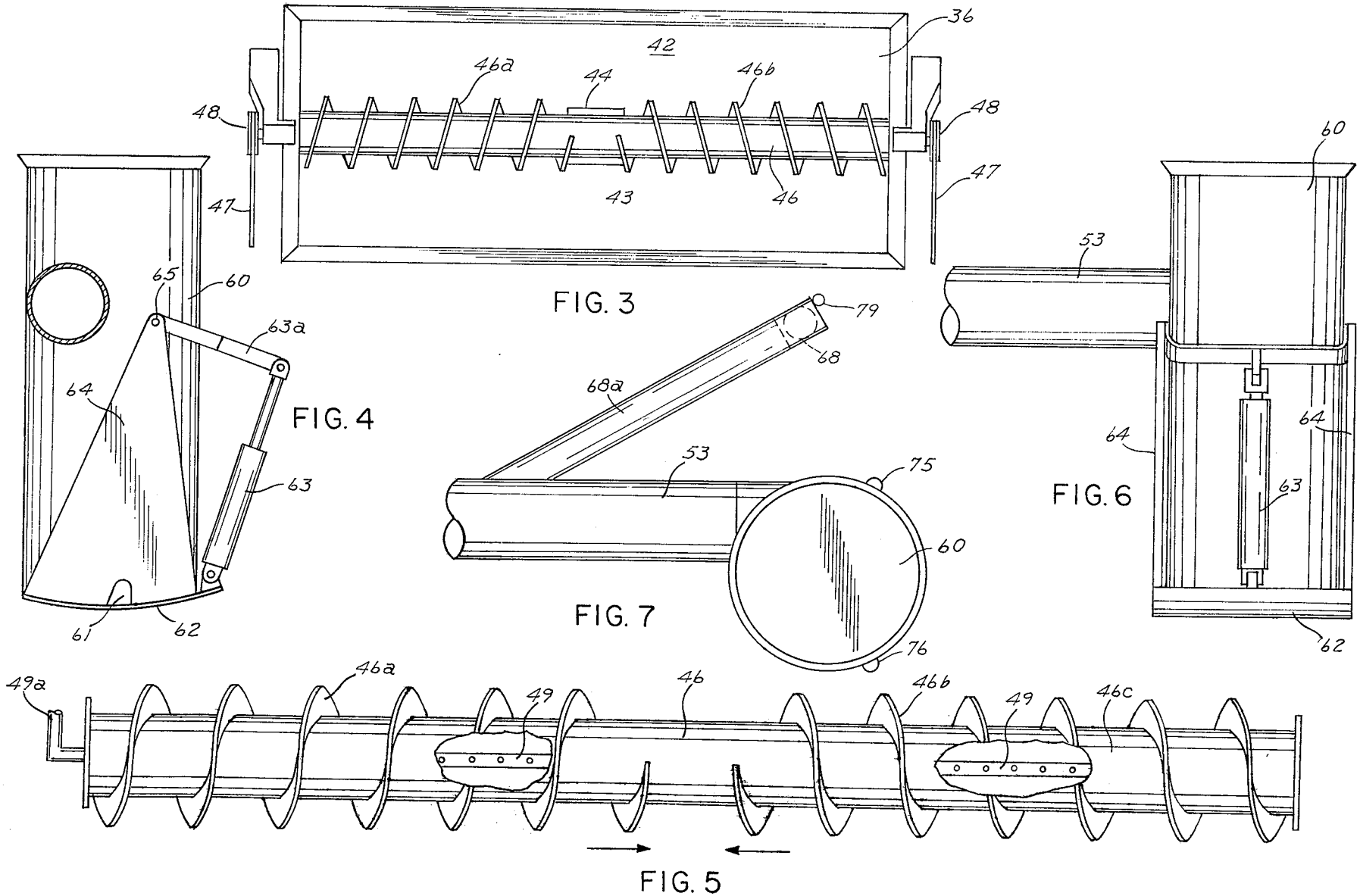
FIG. 3 is a top plan view of a supply hopper according to the invention.
FIG. 4 is a side elevational view of a distribution hopper arranged to receive material from the supply hopper.
FIG. 5 is a broken away side elevational view of the spiral flight conveyor and heater for the supply hopper, FIG. 3.
FIG. 6 is a side elevational view of a distribution hopper according to the invention mounted on an articulated arm.
FIG. 7 is a schematic view of the patching tools mounted on an articulated arm.

The hopper 36, shown in FIG. 3, is provided with sloped bottom sections 42 and 43 which terminate in a generally rounded bottom having a central outlet 44 in the bottom. A spiral flight conveyor 36 is journalled to the end walls of the hopper and it is rotated by belts 47 on pulleys 48 mounted on the ends of the shaft of the spiral flight conveyor. The spiral flight conveyor is provided with two flight sections **46*a* and 46*b* which are spiralled in opposite directions so that, on rotation of the conveyor, material is moved from the outer edges of the hopper 36 to the outlet 44**.

The spiral flight conveyor 46 includes a hollow tubular body section **46*c* on which the flights are mounted, and an elongated gas burner 49 is mounted internally of the tube 46***c*. The burner 49 is provided with propane or other fuel from an inlet 49*a* so that the tube 46*c* may be heated by the burner 49. In this manner, asphaltic patching material adjacent to the tube and generally in the space of the spiral flights may be heated and then moved along the spaces in the two flight sections, to be discharged out the center opening 44 of the hopper 46. This insures heated material being discharged without heating the whole load.

Mounted below the A-frame, FIG. 1, is an articulated arm, shown in general by numeral 50, which is pivoted at one end to a pivot block 51. Extending from the pivot block 51 is an intermediate arm 52 and an outer arm 53 is pivoted to the end of the arm 52. A hydraulic motor and belt drive 55 mounted adjacent the pivot block 51 provides means for pivoting the arm 52 and a hydraulic motor and drive 56 mounted on the end of arm 52 pivots the arm 53 in relation to the arm 52 to thereby articulate the whole arm. A distribution bucket 60 is mounted on the end of the arm 53 and it is arranged to be moved throughout the area shown in general by the circular broken line 61 extending under the trailer and around the back of the vehicle 10. This provides for placing the distribution bucket under the hopper 36, for receiving a charge of asphalt material, and to place it above the area around and near the back end of the truck, when the truck is sitting still in the roadway requiring repairs. The distribution bucket 60 is a tubular member having a rounded outlet 61, FIG. 4, closed by an arcuate gate 62 which is controlled by an articulated hydraulic cylinder 63, mounted on arm 63*a*, attached to pivot 65 and on the gate. This provides opening and closing the gate over the end of the distribution bucket 60. The gate 62 is provided with side arms 64 pivoted at the pivot point 65 on the bucket.

Depending from the arm 53 is a framework 67 extending outwardly at about a 30° angle to the arm 53. Mounted on the end of the framework 67 is a tamper 68 which may be raised and lowered by means of a hydraulic cylinder 69. The tamper 68 is provided with a tamping foot 70 mounted on a shaft 71 for tamping asphaltic material placed in a chuckhole in the highway. The tamper foot 70 is vibrated or actuated by the shaft 71 which is actuated by a motor which may be run by hydraulic fluid, air, electric motor, or the like. A spray line 79 for tack oil extends downwardly from the tamper and includes a nozzle 79*a*. This permits spraying tack oil from lower to higher elevations as the tamper is raised or lowered, to provide a lesser or larger area of oil spray.

A pair of burners 75 and 76, shown schematically in FIG. 7, are mounted on the distribution bucket 60 in a position to provide flame extending downwardly from the bottom end of the bucket. These burners 75 and 76 are mounted on generally opposed sides of the bucket to provide high heating of a chuckhole over which the bucket is placed. These burners may be conventional propane type burners, of the blow torch type, with a sufficient supply to provide the necessary heating for the repair of the roadway. The burners being mounted on the bucket 60, the chuckhole can be heated and asphalt immediately dumped in the heated hole.

In one very useful form the supply hopper 36 is arranged to hold enough asphaltic material to provide a plurality of distribution bucketfuls of asphaltic material so that one loading of the hopper may be utilized for providing a number of the distribution bucketfuls. Further, it is desirable to have the capacity of the supply hopper 60 equal to about the volume of the space between the spiral flights so that, by rotating the spiral flight conveyor a few revolutions, the distribution hopper 60 will be filled. This provides loading the distribution hopper with the heated asphaltic material. The material around the tube 46 is heated by the burner inside of the spiral flight conveyor. Further, when the distribution hopper is loaded and used for repair work, the asphaltic material replacing the heated material (which is discharged) has sufficient time to be itself heated by the burner inside of the tube.

The motors and cylinders on the patching apparatus attached to the vehicle may be easily supplied by fluid lines running from the hydraulic pump and supply reservoir 24 to the various elements necessary. Further, it is contemplated to use solenoid valves to control the flow of hydraulic fluid to individual motors, so that fewer lines are necessary from the hydraulic pump to the trailer section. The electrical leads to the individual solenoids may be formed as a single cable from the control panel 22 in the operator's cab 20 to section 12 and distributed to the individual motors. Furthermore, lines from the oil supply reservoir 26 to the tack oil spray 79 mounted on the bucket 60 provides means for spraying binding or tack oil to the hole in preparation of receiving the hot asphalt from the distribution bucket. It is further contemplated that thermometers may be provided on the supply hopper 36 to control the temperature of the mix and a thermometer may be provided on the oil tank or the emulsion tank for controlling the temperature of the oil or the emulsion.

In using the device of the invention of FIGS. 1–7, the supply hopper 36 is filled with asphaltic material and the burner in the spiral flight conveyor is ignited for maintaining the asphalt hot during the travel of the vehicle through its route of repair work. The prime mover is then driven to the location of the necessary repair work, and the rear end of that vehicle is pulled just past the area requiring repairs. This places the chuckholes and the like in the area between the rear wheels of the prime mover and the wheels of the trailer. When the asphalt mix is at a sufficient temperature, the distribution hopper 60 is placed under the outlet of the supply hopper and the spiral flight is rotated to fill the hopper 60 with the hot asphalt mix. This distribution hopper 60 is then placed over the chuckhole and the burners are electrically ignited so as to burn the trash out of the hole and to heat the surrounding material of the chuckhole itself. When the hole walls and bottom are sufficiently heated, a spray of oil or emulsion is forced into the hole. The burners may then be ignited again for a short period to heat the sprayed oil. Into this hot chuckhole is then placed a charge of asphalt by the opening of the gate of the distribution hopper. When a sufficient amount of asphalt is placed in the chuckhole, the distribution hopper is slightly moved by articulating the arm, so that the tamper foot 70 may be placed over the chuckhole. The tamper is lowered and actuated to tamp the asphaltic material. The tamper foot may be moved around by articulating the arm so as to completely tamp all material in the chuckhole. After the asphalt material is tamped into the chuckhole, the bucket 60 may then be moved to another hole and the process repeated. When all the holes are filled in the reachable area of the stationary truck, it may be moved to a new location. Since the articulated arm is arranged to move around the rear end of the truck, the truck may be moved and maintained in a single lane of traffic while the patching may extend over the single lane, thus providing versatility for the unit.

Figures 8, 9:
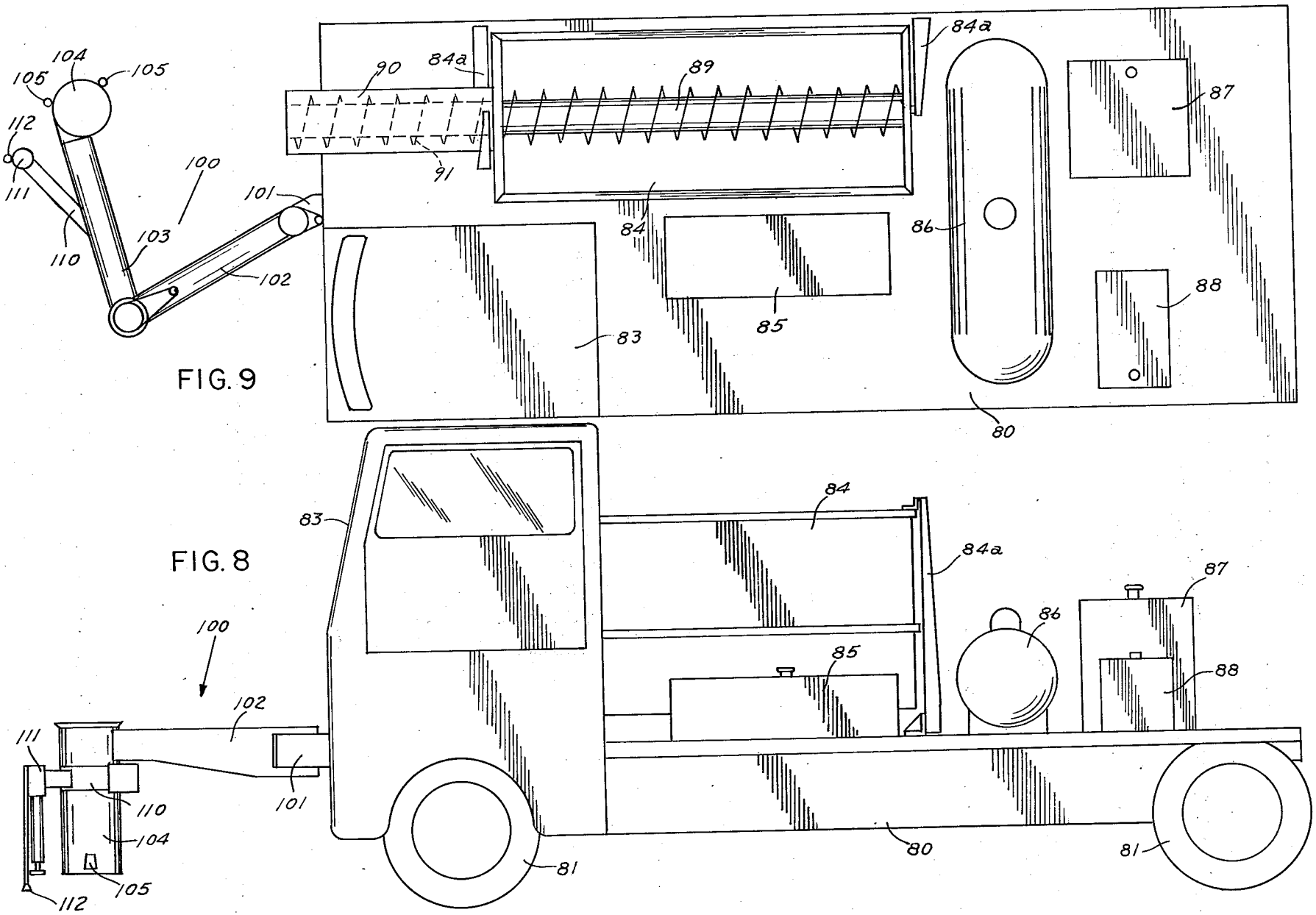
FIG. 8 is a side elevational view of a modified form of the invention illustrating a self-propelled vehicle with the patching equipment mounted as a single unit.
FIG. 9 is a top plan view, schematically, of the device of FIG. 8.

In the modification shown in FIGS. 8 and 9, a self-propelled vehicle is provided with an elevating supply hopper for supplying a distribution hopper on an articulated arm. In this instance, the self-propelled vehicle includes a frame 80 mounted on wheels 81 in a conventional manner. The unit is provided with an operator's cab 83 containing the conventional and necessary appurtenances for operating the vehicle. In this particular instance, included along with the conventional steering wheel, brakes and the like for operating the self-propelled vehicle, a control panel (not shown) is provided for controlling the articulated arm with its distribution bucket, the supply hopper and the necessary actuating units and supply reservoirs, similar to the control panel of FIG. 1. Mounted on the bed of the self-propelled vehicle is a hydraulic oil supply 85 which supplies an integrated hydraulic pump, not specifically shown, operated by the vehicle engine, as is conventional in various types of units utilizing a hydraulic pump for operating equipment mounted on the vehicle. Also, mounted on the bed is a propane tank 86 which may be provided with necessary flexible lines to the burners mounted on the distribution bucket and the auger of the supply hopper, explained below. A tack oil tank 87 is, also, provided on the bed and it likewise has a pump (not shown) and flexible lines leading to the spray mounted on the tamper, explained below. A diesel oil tank 88 is provided on the rear of the bed for use in operating the vehicle as well as providing a spray of oil where required. The diesel oil is likewise pumped through lines by a pump (not shown) to the points of use.

The supply hopper 84 is arranged on movable frame members 84*a* which support the unit in upright position on the truck and pivot to lower the supply hopper 84 to the ground so that it may be filled from a conventional dump truck, in the manner explained for the unit of FIGS. 1–7. The supply hopper 84 is provided with a spiral flight conveyor or auger 89 which is heated in the manner detailed for the unit of FIGS. 1–7, however, it empties into a discharge tube 90 having an extension spiral flight 91 mounted therein, rotatable with the spiral flight conveyor 89. This provides for the transfer of material from the supply hopper 84 outwardly through the tube 90 and for discharge at the end thereof. The motor for the spiral flight conveyor or auger 89 is generally conventional and the raising and lowering mechanism is likewise conventional. The burner mounted in the auger (similar to the burner of FIG. 1–7) is supplied with fluid through flexible lines, not shown, which permit the hopper to move from its upper to its lower position.

Asphalt discharged from the discharge tube 90 may be discharged into a distribution bucket or hopper 104 which is mounted on an articulated arm. The unit includes arm 103 which is pivotally mounted on an arm 102 which in turn is mounted on a bracket 101. The arms are pivoted about its adjoining neighbor by means of a motor and a belt or chain drive as explained above. The distribution hopper is provided with side burners 105 placed at points convenient for the operation of the unit and a side arm 110 supports a tamper arrangement 111. Mounted on the tamper arm is a tack oil spray 112 for spraying oil in a chuckhole which has been heated by the burners 105.

The operation of the mechanism shown in FIGS. 8 and 9 is essentially the same as in the trailer type unit, however, the single operator is in a position to operate both the vehicle and the patching unit. The unit is moved to a position convenient for a dump truck which dumps a load of asphalt into the hopper 84 when it is moved to its down position on the ground in a manner similar to that shown in the unit of FIG. 1. After filling the hopper 84 is moved to its upper position on the vehicle and the vehicle is then moved to an area for patching chuckholes. The front of the vehicle is moved adjacent to the chuckholes and the articulated arm is moved so that the hopper 104 is under the discharge outlet of tube 90 and the hopper is then filled with the heated asphalt, heated by the burner inside of the tube of the spiral conveyor. The filled distribution hopper is then moved over a chuckhole and the burners are ignited to heat the chuckhole and to burn the trash therefrom. When the hole is sufficiently heated, the arm may be moved slightly and tack oil sprayed into the hole by means of the spray 112. The tamper may be moved up or down to arrange the size of spray necessary to accommodate the area of the chuckhole and thereby insure oil completely around the chuckhole. The distribution bucket then is moved over the hole and the burners may be again ignited to heat the tack oil and to insure that the chuckhole is heated for the filling with the hot asphaltic material of the distribution bucket. A sufficient amount of the material is then released from the distribution bucket, as shown in the device above, and the tamper is then moved back over the chuckhole and lowered for tamping the material into the chuckhole. After all of the reachable holes are filled at that location, the vehicle may then be moved to a new location for continued operation. The number of burners on the distribution bucket may be determined by the size of chuckholes which are to be heated and to thereby provide maximum heat in the shortest time possible for speedy operation. Two have been found generally satisfactory. Also, in this configuration hydraulic tubes may be passed to each of the units for operation without the use of solenoids, or a single supply hydraulic line may be provided with branch lines to the various units, which branch lines are then controlled by electric solenoids rather than providing a series of hydraulic lines along the articulated arm. This permits the use of a small multilead electric cable instead of a plurality of hydraulic lines.

It has been found in use, that the auger may be reversed from its discharge direction, to mix the asphalt material in the hopper. Various types of drives may be used for the movable members, such as chain and sprocket, where appropriate, hydraulic cylinders and motors, electric motors, etc.

I claim:

1. In an asphalt pavement patching vehicle having a supply hopper provided with an outlet and a small distribution hopper mounted on an articulated arm for distributing small portions of asphalt material from said supply hopper to a predetermined area comprising:

a. auger means mounted in the supply hopper arranged to move material to said outlet and said outlet being positioned for depositing the asphalting material into the distribution hopper, said auger means including a central tube member supporting helical flights for movements of material;

b. burner means extending internally of and along said tube member for heating said tube member and the asphalting material surrounding said tube member;

c. frame means for the supply hopper arranged for supporting the same in an elevated position on the vehicle for supplying asphalting material to said distribution hopper by gravity and constructed for lowering the supply hopper to ground level permitting filling of the same with a conventional dump truck; and d. means mounted between said frame means and said supply hopper for moving the supply hopper to and from ground level to its elevated position.

2. In the asphalt pavement patching device of claim 1, wherein the supply hopper is mounted on a trailer device attached to the vehicle so that the supply hopper is spaced from the vehicle and the distribution hopper articulated arm is attached to the vehicle and is movable to a position to receive material from the supply hopper.

3. In the asphalt pavement patching device of claim 2, wherein the supply hopper is provided with a central lower outlet and said auger includes a pair of oppositely wound spiral flights for moving material in the supply hopper to said central outlet.

4. In the asphalt pavement patching device of claim 1 wherein the supply hopper is mounted on the vehicle in a position to be lowered to one side of the vehicle and to discharge material at one end of the supply hopper in elevated position.

5. In the asphalt pavement patching device of claim 1 being further characterized by having tamper means adjacent the distribution hopper, means arranged to raise and lower said tamper means independently of said distribution hopper, and tack oil spray means mounted on said tamper means providing area adjustment of the spray from said oil spray means by raising and lowering said tamper means.

6. An asphalt pavement patching device of claim 1 wherein the supply hopper is mounted on a two wheel trailer depending from the rear of the vehicle having an enlarged space between the vehicle and the trailer, permitting free movement of the distribution hopper around the rear end of the vehicle.

7. An asphalt pavement patching device of claim 6 wherein a control cab for the patching tools is mounted on the vehicle.

* * * * *